United States Patent [19]

Meyer et al.

[11] Patent Number: 4,513,675

[45] Date of Patent: Apr. 30, 1985

[54] PRESSER FOOT AUTOMATIC LIFTING DEVICE

[75] Inventors: Horst Meyer, Bad Salzuflen; Günter Landwehr, Bielefeld, both of Fed. Rep. of Germany

[73] Assignee: Kochs Adler AG, Bielefeld, Fed. Rep. of Germany

[21] Appl. No.: 487,744

[22] Filed: Apr. 22, 1983

[30] Foreign Application Priority Data

May 6, 1982 [DE] Fed. Rep. of Germany ..... 3216996

[51] Int. Cl.[3] ..... D05B 27/06; D05B 29/02

[52] U.S. Cl. ..... 112/236

[58] Field of Search ..... 112/236, 237, 320, 322, 112/153, 312

[56] References Cited

U.S. PATENT DOCUMENTS

| | | | |
|---|---|---|---|
| 1,242,403 | 10/1917 | Weis . | |
| 2,106,517 | 1/1938 | Christensen et al. | 112/320 X |
| 2,386,840 | 10/1945 | Colegrove | 112/236 |
| 2,544,029 | 3/1951 | Kotzin et al. | 112/236 |
| 3,263,634 | 8/1966 | Gross | 112/153 |
| 3,282,237 | 11/1966 | Niekrawietz | 112/236 |
| 3,828,704 | 8/1974 | Von Hagen et al. | 112/320 |
| 3,948,195 | 4/1976 | Chudner | 112/322 |
| 4,067,275 | 1/1978 | Wilhembacher | 112/320 |
| 4,292,907 | 10/1981 | Gilbride et al. | 112/236 |

FOREIGN PATENT DOCUMENTS

| | | | |
|---|---|---|---|
| 399873 | 4/1922 | Fed. Rep. of Germany . | |
| 770823 | 9/1934 | France | 112/236 |

*Primary Examiner*—Henry S. Jaudon
*Assistant Examiner*—Andrew M. Falik
*Attorney, Agent, or Firm*—Laff, Whitesel, Conte & Saret

[57] ABSTRACT

A sewing machine with a workpiece feed comprises a feed dog positioned below the workpiece providing a four-motion feed movement. A presser foot is fixed to a presser foot bar and can be raised from the workpiece during the stitching cycle by a lifting gear to ensure turning of the workpiece. This makes it possible to follow complicated seam patterns. The lifting gear is constructed in such a way that the presser foot is raised from the workpiece while the needle perforates the material, during its downwardly directed movement approximately up to its bottom dead center position.

8 Claims, 7 Drawing Figures

PRESSER FOOT AUTOMATIC LIFTING DEVICE

BACKGROUND OF THE INVENTION

This invention relates to sewing machines.

A sewing machine is known from U.S. Pat. No. 1,242,403 which has a so-called skipping feed, which roughly performs a square movement. An upper feed means performing a movement of the same type is associated with this skipping feed. The skipping feed and the feed means are necessarily disengaged from the workpiece during the insertion of the needle thereinto and during looping during the upward movement of the needle. During this time a presser foot, resiliently displaceable against its drive, driven in the movement cycle and in the particular movement direction of the needle, is pressed from above against the workpiece, so that the latter is pressed against the throat plate or the base plate of the lower arm which surrounds it. Thus, in the vicinity of the stitching point, the workpiece is either fixed between the feed and the feed means or between the throat plate and the presser foot. The small-area construction of the presser foot is intended to ensure a relatively easy rotatability of the workpiece, in order to be able to follow major curves or angles of the seam to be produced.

German Patent Specification No. 399873 discloses a mending sewing machine, which does not have a feed dog. Its presser foot is in each case raised by the workpiece, when the needle has been removed therefrom and is engaged again when the needle is inserted. This enables the material to be moved, which is performed in a completely free manner by the operator and can be in a random direction.

SUMMARY OF THE INVENTION

The object of the invention is to provide a sewing machine which permits workpieces to be turned as easily as possible during sewing in order to follow complicated seam profiles easily.

Accordingly, the present invention provides a sewing machine comprising a feed dog for a workpiece to be sewn, said feed dog having a workpiece conveyor performing a skipping feed and adapted to be positioned beneath the workpiece, a presser foot fixed to a presser foot bar, at least one needle, an arm shaft for raising and lowering said needle and a lifting gear for raising the presser foot from the workpiece during the stitching cycle of said needle, said lifting gear being constructed in such a way that during the insertion of said needle during its downwardly directed movement and roughly until it reaches the bottom dead center thereof, the presser foot is raised from the workpiece.

The essence of the invention is that during the insertion of the needle, i.e. during the downward movement thereof from the instant of insertion to the bottom dead center, the workpiece is not subject to any contact pressures from above, apart from the minor compressive forces, caused by the friction between needle and workpiece during insertion and which are in fact desirable for ensuring a clean engagement of the workpiece on the throat plate in the stitch formation zone. During this time, the workpiece can be turned in a completely free manner, which makes matters much easier in the case of heavier materials, such as leather or heavy fabrics, e.g. canvas or the like. However, in the case of very soft materials, these measures ensure that the seam profile can be effected in sharply curved portions or even in corners, without causing distortion of the workpiece. Owing to the fact that turning takes place precisely around the inserted needle, a fine appearance of the seam profile is ensured, so that such measures can in particular be used when producing pot seams, i.e. seams which are visible from the outside, but also in general for producing form seams.

Preferably, the lifting gear has a cam plate drive which is arranged to be driven by said arm shaft and which is coupled to the presser foot bar by means of a transmission rod.

The lift by which the presser foot is raised from the workpiece is desirably adjustable. This measure is particularly advantageous for adapting to different compressibilities of the workpiece material. The position to which the presser foot can be raised from the workpiece may also be adjustable. This measure is appropriate to use for adapting to particularly thin or particularly thick workpieces.

According to a preferred embodiment the presser foot is constructed as a support for a rotating, intermittently drivable feed means. The feed means may comprise a timing belt. These measures are particularly advantageous for producing crinkle-free seams.

If it is to be ensured that with an otherwise manual guidance of the workpiece, the seam to be produced has a constant spacing with respect to the workpiece edge, a stop plate may be provided having a bearing edge facing the needle. The spacing between the needle and the bearing edge is desirably adjustable.

BRIEF DESCRIPTION OF THE DRAWINGS

The invention will now be further described, by way of example, with reference to the drawings, in which.

DESCRIPTION OF THE PREFERRED EMBODIMENT

Figure 1:
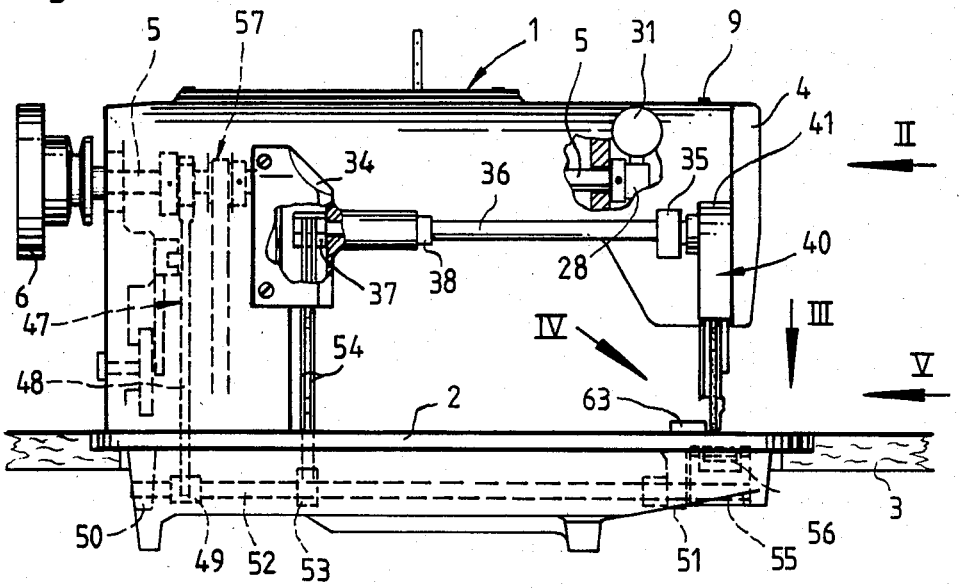
FIG. 1 is a rear view of one embodiment of a sewing machine according to the invention.

Referring to the drawings, a sewing machine 1 is provided on its top surface with a lower arm constructed as a base plate 2 and which is received in a workpiece supporting plate 3. A hollow upper arm 4, i.e. constructed in the form of a housing, is fixed to the base plate 2. An arm shaft 5 is mounted in rotary manner in said upper arm 4 and is provided at one end with a handwheel 6 and with its free end terminates in a not shown, conventional, crank gear, which is used for driving a needle bar 7 with a needle 8. A presser foot bar 9 is displaceably mounted in the upper arm 4 (FIG. 2) and to its lower end is secured a presser foot 10. The presser foot 10 is constructed with a guide roller 11 and a groove 12 for receiving a timing belt 13. The presser foot bar 9 is surrounded by a compression spring 14, one end of which is supported by means of a disk 15 on the upper arm 4, while the other end of which is supported on a bearing block 16, which is fixed by means of a setscrew 17 to the presser foot bar 9. To the bearing block 16 is hinged a tie rod 18, whose free end is held and guided in a rotary, adjustable manner in an oblong hole 20 of a lever 21 by means of an adjusting screw 19. This oblong hole fixture is used for adjusting the height of lift a of the presser foot 10 and consequently to bring about adaptability to different conpressibilities of the workpiece materials. The lever 21 is fixed to a shaft 22, which is rotatably mounted in the arm 4. One end of a lever 24 is adjustably fixed by means of a clamping connection 23 to the shaft 22, said lever having a recess 25 for receiving a roller 27 which is rotatably mounted on a bolt 26. The roller 27 is in contact with a cam disk 28 secured in angularly adjustable manner to the arm shaft 5. At its free end 29, i.e. at the end opposite to the clamping connecting 23, the lever 24 has a bearing surface 30. A one-way pneumatic cylinder 31 is secured by screws 32 to the upper arm 4 and has a piston rod 33 which projects into the upper arm 4 above the arm shaft 5 and which can co-operate with the bearing surface 30 of the lever 24. The above-described mechanism, which is in driving connection with the presser foot bar 9, forms a lifting gear H. Adjustment of the height a of the bearing block 16 on the presser foot bar 9 and/or a corresponding adjustment to the clamping connection 23, makes it possible to adapt the stroke length of the presser foot 10 to different workpiece thicknesses.

Figure 2:
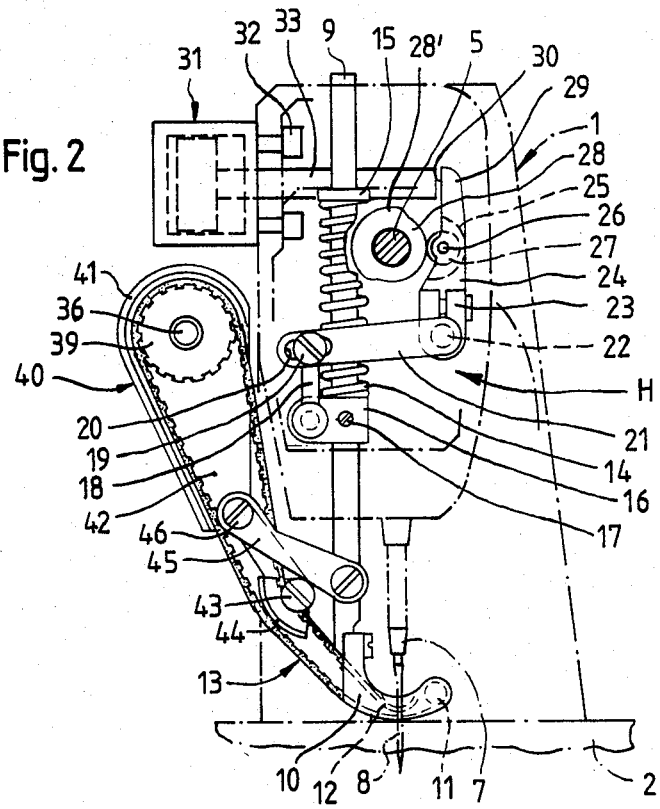
FIG. 2 is a side view of the sewing machine taken in the direction of the arrow II in FIG. 1.

A shaft 36, extending parallel to the arm shaft 5, is pivotably mounted in bearings 34, 35 on the upper arm 4 (FIG. 1). One end of the shaft 36 projects into a not shown ratchet brake with laterally positioned bearings (Torrington type). Such constructions are, for example, known from U.S. Pat. No. 4,271,776. This ratchet brake is connected to a crank 37. Laterally of the bearing 35, the shaft 36 is axially fixed by means of an adjusting ring 38 and its other end, facing the presser foot 10, is connected in non-rotary manner with a gear wheel 39, around which passes the timing belt 13. A rocking lever 40 is pivotably mounted on the shaft 36, said lever being provided with a cap 41 covering the gear wheel 39 and a downwardly radially extending lever 42 (FIG. 2). The lower end of the lever 42 carries a guide member 44 for the timing belt 13 which is fixed to the lever 42 by means of a screw 43. One end of a guide lever 45 is fixed by a shoulder screw 46 to the lever 42 and its other end is secured to the presser foot bar 9.

Within the upper arm 4 is arranged a conventional stitch regulating gear 47, which is connected with a crank 49 by means of a tie rod 48. The crank 49 is mounted in non-rotary manner on a sliding shaft 52 which is mounted in bearings 50, 51 below the base plate 2, while a further crank 53 is fixed in non-rotary manner to the shaft 52. Cranks 53 and 37 are connected in driving manner by means of a tie rod 54. The sliding shaft 52 is provided with a feed fork 55, connected by means of a bolt (not shown) to a conveyor beam 56, which is supported by a crank (not shown) on an eccentric lug of a shaft (not shown) connected to the arm shaft 5 by means of a timing belt gear 57. In the vicinity of the needle 8, a feed dog 58 is arranged on the conveyor beam 56. A throat plate 62 having a recess 60 for the feed dog 58 and a stitch hole 61, is secured by means of screws 59 to the base plate 2. A stop plate 63 is adjustably fixed, by means of a screw 66 engaging in an elongated slot 65 in said stop plate 63, to the base plate 2, so that the distance between a bearing edge 64 of the stop plate 63 and the stitch hole 61 and consequently the distance from a seam to the workpiece edge is adjustable. In general, the bearing edge 64 is linear and runs parallel to the conveying direction of the feed dog 58. In addition, in the conveying direction, the bearing edge 64 extends on either side of a vertical line through the stitch hole 61, so that the workpiece edge can be guided in all cases tangentially to the bearing edge 64. The presser foot 70 and the feed dog 58 form a feeding device. As generally usual, the feed dog 58 performs a four-motion feed movement causing a skipping feed.

Operation takes place as follows. It is assumed that before the start of working, the needle 8 of the sewing machine is in its uppermost position and, due to the operation of the working cylinder 31, the presser foot 10 is in the raised position. The operation of the working cylinder 31, i.e. the extension of its piston rod 33, ensures, through the co-operation of said rod 33 with the bearing surface 30, that the lever 24 is pivoted around the shaft 22, so that simultaneously the lever 21 is rotated. The upward movement of the lever 21 is transmitted by means of the tie rod 18 to the bearing block 16, so that the presser foot bar 9 is raised against the force of the compression spring 14, so that the presser foot 10 is disengaged from the throat plate 62. During the upward movement of the presser foot bar 9, by means of the guide lever 45, the lever 42 and consequently the guide member 44 is pivoted away from the presser foot bar 9, so that the timing belt 13, constructed as the upper material displacement means, remains in the tensioned position. By operating the cylinder 31, the roller 27 is simultaneously moved out of the action area of the cam disk 28.

Figure 3:
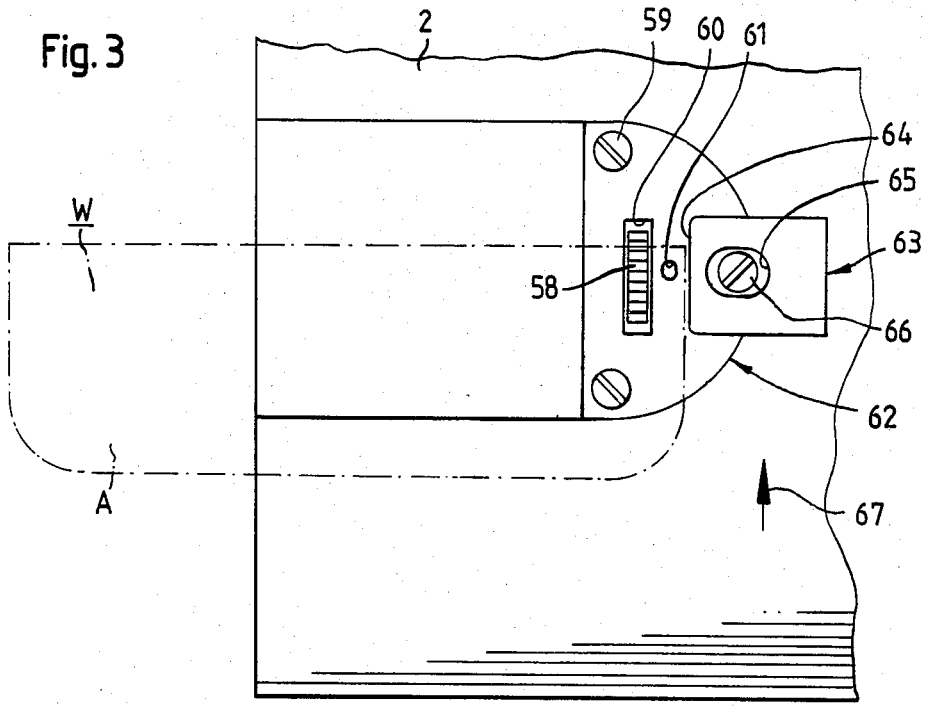
FIG. 3 is a plan view of the base plate of the sewing machine base plate taken in the direction of the arrow III in FIG. 1.
Figure 4:
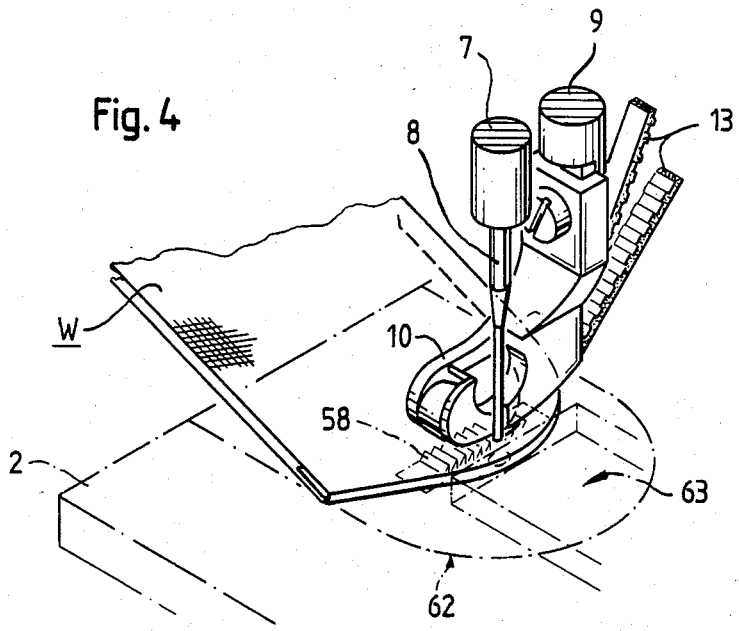
FIG. 4 is a perspective view taken in the direction of the arrow IV in FIG. 1.

A workpiece W, which in FIG. 3 is shown in exemplified manner in the form of a shirt cuff, is placed in the initial position A on the base plate 2 of the sewing machine 1, the outer workpiece edge being engaged with the bearing edge 64 of the stop plate 63.

On operating a not shown starting button of a control means, initially the pneumatic working cylinder 31 is reversed, so that the presser foot 10 is lowered on to the workpiece W. On rotating the arm shaft 5, an oscillatory movement is produced in the stitch regulating gear 47, which causes an intermittent movement of the shaft 36 and consequently the timing belt 13, as the upper material displacement means, due to the ratchet brake located in the crank 37.

Figure 5A:
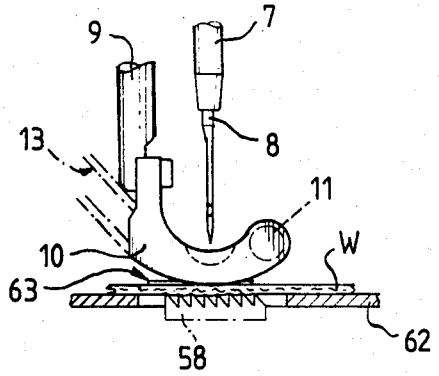
FIGS. 5*a* to 5*c* show the stitch formation area of the sewing machine taken in the direction of the arrow V in FIG. 1 and showing different phases of the needle movement.
Figure 5C:
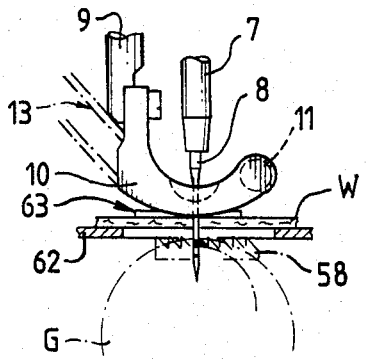
Figure 5B:
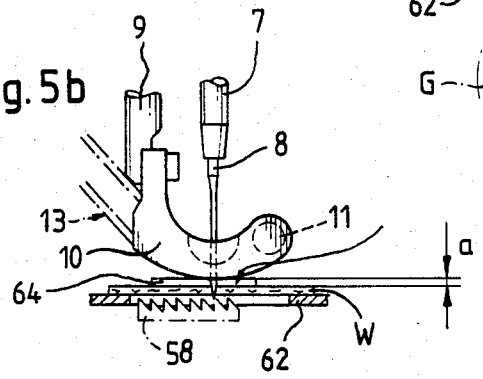

Simultaneously, the feed dog 58 performs a feed movement, so that the workpiece W is moved in the direction of arrow 67. As soon as the tip of the needle 8 stitches the workpiece W, cf. FIG. 5*b*, the cam disk 28 with its operating cam 28' runs on to the roller 27 of the lever 24, so that the latter is pivoted. By means of the lever 21, the presser foot bar 9 and consequently the presser foot 10 is raised by a small amount from the workpiece W, which corresponds to the height of lift a. Simultaneously, the feed dog 8 has assumed a position in which it is located below the bearing surface for the workpiece W, i.e. below the surface of the throat plate 62. As no frictional forces are now exerted by the timing belt 13, in the form of the upper material displacement means, or the feed dog 58 on the workpiece W, the latter can be easily turned or can be aligned with respect to the bearing edge 64 of the stop plate 63. During further stitch formation, the needle 8 performs its downward stroke into the lowermost position, i.e. down to bottom dead center, where it performs an upward movement, at the beginning of which the loop lifting movement necessary for stitch formation takes place. When, during its downward movement, the needle 8 reaches bottom dead center, the presser foot 10 is again lowered on to the workpiece W, due to the corresponding shaping of the operating cam 28' of the cam disk 28, so that during the formation of the thread loop (FIG. 5*c*), which is seized by hook G, the workpiece W is held firmly on the throat plate 62. The presser foot 10, which simultaneously carries a circulating material displacement means (timing belt 13), at this time simultaneously fulfils the function of a presser pad for the workpiece W. The needle 8 is moved further upwards during the further stitch formation cycle. When the needle 8 has left the workpiece W, the latter is again moved and the operation can be repeated to form another stitch.

The invention is not restricted to the above described embodiment but modifications and variations may be made without departing from the scope of the invention as defined by the appended claims.

We claim:

1. A sewing machine comprising a feed device for a workpiece to be sewn, said feeding device having a feed dog performing a four-motion feed movement and adapted to be positioned beneath the workpiece, a presser foot fixed to a presser foot bar, at least one needle, an arm shaft for raising and lowering said needle and a lifting gear for raising the presser foot from the workpiece during the stitching cycle of said needle, said lifting gear being constructed in such a way that during the insertion of said needle into the workpiece during its downwardly directed movement and approximately until it reaches its bottom dead center position, the presser foot is raised from the workpiece.

2. A sewing machine as claimed in claim 1, in which the lifting gear has a cam plate drive which is arranged to be driven by said arm shaft and which is coupled to the presser foot bar by means of a transmission rod.

3. A sewing machine as claimed in claim 1, in which the lift by which said presser foot is raised from the workpiece is adjustable.

4. A sewing machine as claimed in claim 1, in which the position to which the presser foot can be raised from the workpiece is adjustable.

5. A sewing machine as claimed in claim 1, in which the presser foot is constructed as a support for a rotating, intermittently drivable feed means.

6. A sewing machine as claimed in claim 5, in which said feed means comprise a timing belt.

7. A sewing machine as claimed in claim 1, in which a stop plate having a bearing edge facing said needle is provided for guiding the workpiece.

8. A sewing machine as claimed in claim 7, in which the spacing between said needle and said bearing edge is adjustable.

* * * * *